United States Patent [19]

Francis

[11] Patent Number: 4,858,814

[45] Date of Patent: Aug. 22, 1989

[54] AUTOMATIC NAILER SYSTEM

[76] Inventor: Terry E. Francis, Poplar Court, Cae-Hopkin, Abercave, Powys, South Wales SA9 1TP, United Kingdom

[21] Appl. No.: 162,054

[22] Filed: Feb. 29, 1988

[30] Foreign Application Priority Data

Mar. 5, 1987 [GB] United Kingdom ..... 8705130

[51] Int. Cl.[4] ..... B25C 7/00

[52] U.S. Cl. ..... 227/149; 227/147

[58] Field of Search ..... 227/147, 149; 279/23, 279/46 A, 79

[56] References Cited

U.S. PATENT DOCUMENTS 1,568,308 1/1926 Albee ..... 227/147

3,245,596 4/1966 Lygo ..... 227/147 X 4,232,934 11/1980 Feinbloom ..... 279/23 R X

*Primary Examiner*—Frank T. Yost

*Assistant Examiner*—James L. Wolfe

*Attorney, Agent, or Firm*—SIlverman, Cass, Singer & Winburn, Ltd.

[57] ABSTRACT

The present invention, provides an automatic nailer system, for securing nailed ferrules to a substrate, comprising:

a body defining a generally cylindrical channel for receiving a nailed ferrule with the nail and the channel being approximately coaxial;

A hammer rod reciprocable within the channel between a retracted position and an extended position;

apparatus for feeding a nailed ferrule into the channel when the hammer rod is in its retracted position; and a collet mechanism comprising a plurality of collet pieces which are biased to move radially to abut one another and define a passage;

the passage having a tapered section which at its opening has a cross-sectional size and shape generally the same as those of the channel and leading at its other end into a generally cylindrical section for receiving coaxially and snugly the nail of a nailed ferrule, the collet mechanism being located on the end of the body remote from the hammer rod such that the channel and the passage are coaxial and the wider end of the tapered section is adjacent the channel, and the free end of the hammer rod in its extended position extending at least as far as the wider end of the tapered section of the passage. The invention also provides a collet mechanism for use with the automatic nailer system.

18 Claims, 1 Drawing Sheet

AUTOMATIC NAILER SYSTEM

BACKGROUND OF THE INVENTION

The present invention relates to an automatic nailer system particularly, but not exclusively, for use in the joinery industry.

In manufacturing items of joinery, such as doors and cupboards, it is common practice nowadays to provide a moulded plastic trim to cover over the joints between sections of the item. Such trim is also provided for general decoration of finished chipboard furniture. For instance, a door may comprise one or more chipboard panels located in grooves in a surrounding softwood frame. To cover the grooves and the joints between each panel and the frame, a generally triangular moulded plastic trim may be fitted onto the door at the periphery of each panel.

In a commonly used method, the trim is fitted by nailing a number of metal ferrules at predetermined spacings onto the panel and the frame. Each ferrule is generally cylindrical and has a step at approximately its mid point. The thicker portion of the ferrule is tapered from the step towards the end. Each ferrule is fixed by a nail passing through a central cylindrical hole running through the ferrule transverse to the step. Each ferrule is fixed to the panel or frame so that its thinner portion abuts the panel or frame thereby forming a groove comprising the panel or frame, the cylindrical surface of the thinner portion of the ferrule and the bottom of the step. A flange provided on the trim is clipped into the groove to retain the trim in place.

In order to ensure that the trim fits properly, it is necessary to ensure that the ferrules are correctly aligned with one another. At present, this is achieved by an operator first manually marking out, for instance with a bradawl, the position at which each ferrule is to be located and then manually hammering a nail through the ferrule into the marked position. As the nails and, in particular, the ferrules are small (each ferrule being in general about 4 mm long and at maximum 5 mm in diameter), this is a delicate task and therefore cannot be carried out quickly, even by a skilled worker. Moreover, as any given door will generally have a minimum of twenty four ferrules, the time taken to fit the ferrules properly on the door will be considerable.

Moreover, since the nails are driven in manually, they are not always accurately aligned with the markings. Thus, when the trim is fitted, it is often not straight and a further operation needs to be carried out to bend the nails so that the trim can be located properly on the door.

This method of fitting trim is therefore disadvantageous in that it is labour intensive, slow and not always accurate. However, it has the advantage that the trim is positively and permanently located on the door.

There has therefore been a trend in recent years towards the use of double sided adhesive tape for locating the trim on a door. This speeds up the process for fitting the trim, since it is only necessary to strip the protective cover from the adhesive tape and lay a length of trim adjacent a template. This also gives more accurate location of the trim. However, this process is disadvantageous because it increases substantially the cost of the trim, since the trim needs to be solid and have on it the double-sided adhesive tape. Moreover, it does not lead to a permanent fixture of the trim, since the adhesive effect of the tape can readily be overcome by adverse atmospheric conditions, such as bright sunlight, aging or physical force.

In order to enable a return to the less expensive and more advantageous method of fixing trim using ferrules, the present inventor has devised an automatic nailing machine for attaching ferrules to a substrate. This machine is described in EP-A-No. 0 172 729.

The disclosed machine resembles a conventional automatic nailer, for instance of the type commercially available from Spot Nails Limited of Cardiff, South Wales. These nailers work in a similar fashion to a stapling machine and comprise a track having an elongate opening along which a strip of nails is urged by a spring bias. A piston driven hammer drives the end one of the strip of nails into a substrate. The nails are held together in the form of a strip either by a flexible lacquer coating (similar to the coating used to hold a strip of staples together) for small nails with a small or no head, or by a flexible strip of adhesive paper or plastic for larger nails with a substantial, generally T-shaped, head.

Up until the development of the machine shown in EP-A-No. 0 172 729, it had not been possible to use an automatic nailer to fix ferrules to door frames or panels, since it was not possible to align the ferrule and the nail sufficiently well to ensure that the ferrule would correctly receive the nail as the nail is being hammered into the substrate. This could lead to damage to the ferrule, the automatic nailer and/or the substrate. Moreover, with the larger nails, the paper or plastic strip would be driven with the nail and would interfere with the correct orientation of the ferrule on the substrate.

The machine shown in EP-A-No. 0 172 729 overcame these problems in a novel and inventive way by producing the ferrule in plastics and using the ferrule to guide the nail into an automatic nailer. Moreover, the head of the automatic nailer needed to be substantially redesigned so as to ensure that the ferrule and nail remained correctly aligned with the substrate as they were being hammered in. The ferrule containing the nails could be supplied in strip form with the end ferrule being severed from the strip during each nailing operation.

While the machine shown in EP-A-No. 0 172 729 enables a significant improvement over the prior art trim fixing method to be achieved, it still has some disadvantages. For instance the machine can be used as a hand-held gun, in which case the operator needs to be careful to ensure that the nail and ferrule are placed in the correct place. This can be difficult, as the machine can be bulky and heavy Alternatively, an array of such machines can be arranged over a work station for simultaneous operation. This overcomes any problems with accuracy. However, because of the bulk of the machines, it may not be possible to arrange the desired number of machines at a single station, especially at the corners of a panel. It may therefore be necessary to reduce the number of ferrules fitted or to use two or more ferrule fitting stations.

A further disadvantage of said machines is that they have a relatively limited capacity, and therefore need reloading relatively frequently. This could be a significant disadvantage in a commercial operation.

There is therefore still a need for a system which enables ferrules to be fixed to an item of joinery in a commercial production line at a single station. It is an objection of the present invention to provide such a system.

According to the present invention, there is provided an automatic nailer system, for securing nailed ferrules to a substrate, comprising:

a body defining a generally cylindrical channel for receiving a nailed ferrule with the nail and the channel being approximately coaxial;

a hammer rod reciprocable within the channel between a retracted position and an extended position;

means for feeding a nailed ferrule into the channel when the hammer rod is in its retracted position; and a collet mechanism comprising a plurality of collet pieces which are biased to move radially to abut one another and define a passage;

the passage having a tapered section which at its opening has a cross-sectional size and shape generally the same as those of the channel and leading at its other end into a generally cylindrical section for receiving coaxially and snugly the nail of a nailed ferrule, the collet mechanism being located on the end of the body remote from the hammer rod such that the channel and the passage are coaxial and the wider end of the tapered section is adjacent the channel, and the free end of the hammer rod in its extended position extending at least as far as the wider end of the tapered section of the passage.

In use, the system will start with the hammer rod in its retracted position. A nailed ferrule will then be fed into the channel. The nailed ferrule will be located approximately coaxially in the channel and will move towards the collet mechanism. As the nailed ferrule moves into the collet mechanism, the nail enters the cylindrical section of the passage and is retained therein accurately aligned with the axis of the channel. The ferrule abuts the tapered section of the passage. The hammer rod is then moved to its extended position, striking the nail and driving it into the substrate. As the ferrule moves with its nail, it bears on the tapered section and causes the collet pieces to move radially outward against their biases to allow the nailed ferrule to be attached to the substrate. The hammer rod will then move back to its retracted position and the cycle can be repeated.

Preferably, the ferrule, the channel and the passage are each circular in cross-section. However, it would also be possible to have ferrules of other cross-sectional shapes, such as square or rectangular, in which case it would be necessary to make all the other parts of the system of complementary shape. Clearly the body may be of any convenient shape and need not be of a shape related to the shape of a ferrule.

Preferably, each ferrule is made of a plastics material, such as an engineering grade of nylon. Using such a plastics material enables the ferrule to be made of such a size that the nail is firmly gripped by the ferrule to form a nailed ferrule. It is possible to use metal ferrules, but these cannot so readily grip the nail and may therefore present difficulty in feeding nailed ferrules to the channel.

The hammer rod may be reciprocated by any convenient means, such as a percussion device or a hydraulic cylinder. Preferably, the hammer rod is connected to a piston which comprises part of a pneumatic ram.

The reciprocating means may be single acting to drive the hammer rod from its retracted to its extended position, in which case it will be necessary to provide means, such as a return spring, for returning the hammer rod to its retracted position.

Preferably, the reciprocating means is double acting, whereby it moves the hammer rod both into and out of its extended position.

The means for feeding nailed ferrules into the channel preferably comprises an appropriately shaped passageway connecting the channel to the outside of the body. Preferably, the axis of the passageway is at an acute angle to the axis of the channel, and most preferably, the angle between the two axes is less than 45°.

Nailed ferrules may be fed to the passageway by any convenient means. For instance, the feed means may comprise a vibratory bowl hopper for receiving a substantial number of nailed ferrules and a pneumatic feed system for feeding such nailed ferrules one at a time to the passageway. The feed system may be controlled electrically or pneumatically in response to the operation of the hammer rod. Such systems are well known and need no further explanation. Advantageously, the hopper is used to feed nailed ferrules to a plurality of systems according to the invention.

Preferably, the collet mechanism comprises three collet pieces arranged symmetrically around a common axis. These pieces may be arranged in grooves in a collet body and held in place by a collet plate secured to the collet body. If the collet plate and body are screwed or otherwise removably secured together, it will be readily possible to replace worn collet pieces.

Advantageously, the collet pieces are biased by spring means, and in the preferred embodiments the spring means comprise a coil spring located radially outwardly of the collet pieces in the grooves in the collet body.

It will be evident to those skilled in the art that the radially inward ends of the collet pieces will need to be suitably profiled such that, when they abut one another, the collet pieces define the passage.

Preferably, the angle of the tapered section with respect to the axis of the passage is less than 45° so as to ensure that the collet pieces are easily moved against the bias by the action thereon of the ferrule.

Although it is envisaged that, in general the system of the present invention will comprise only one channel, hammer rod, set of collet pieces, and feed means, it is also envisaged that a single body could contain a plurality of, especially two, sets of such components in a single body so that a plurality of nailed ferrules could be secured to a substrate. The reciprocation of the hammer rod could be achieved using a separate means for each rod or, preferably, using the same means for all the rods.

A system having two channels in the same body is envisaged as being of particular use at corners of articles of joinery where there are constraints on space.

According to a second aspect of the present invention, there is provided a collet mechanism for use in an automatic nailer system according to the present invention.

In the automatic nailer system of the present invention, it will be possible to make the body of very small cross-section and to locate the feed means for the nailed ferrules remote from the body, and it will thus be possible to locate a large number of such systems in a small space, advantageously using a single feed means for supplying a plurality of bodies. Moreover, the use of a body having two sets of components will enable ferrules to be readily nailed to corners of joinery items. The present system is thus well adapted for automated manufacture of joinery items.

Moreover, the system ensures that at all times the nailed ferrule is at least approximately correctly aligned and that during the actual driving of the nail into the substrate, the alignment is substantially correct. Thus, the system of the present invention can be used automatically without the need to check on alignment after a nailed ferrule has been inserted.

BRIEF DESCRIPTION OF THE DRAWINGS

Some embodiments of systems according to the present invention are now described, by way of example only, with reference to the accompanying drawings, in which

FIG. 7 is a perspective view illustrating a conventional vibrating hopper and pneumatic feeder.

Figure 1:
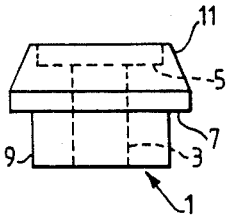
FIG. 1 is a side view of a ferrule for use with the system.

Referring now to there is shown a ferrule 1 for use in the system of the invention. The ferrule 1 is moulded from an engineering grade nylon and is circular in cross section when viewed from above. The ferrule 1 has a central axial cylindrical hole 3 which is stepped at 5. The hole 3 and stepped portion 5 are dimensioned to receive snugly the shaft and head respectively of a round-head wire nail.

DESCRIPTION OF THE PREFERRED EMBODIMENTS

On its outer surface, the ferrule has a centrally located step 7 below which is a cylindrical portion 9 and above which is a tapered portion 11. When in place on a substrate, the surface of the substrate, the outer surface of the cylindrical portion 9 and the bottom of the step 7 form a groove for receiving an abutment on a piece of trim to be located on the substrate. The tapered portion 11 ensures that the presence of the ferrule 1 does not interfere with the fitting of the trim.

Figure 2:
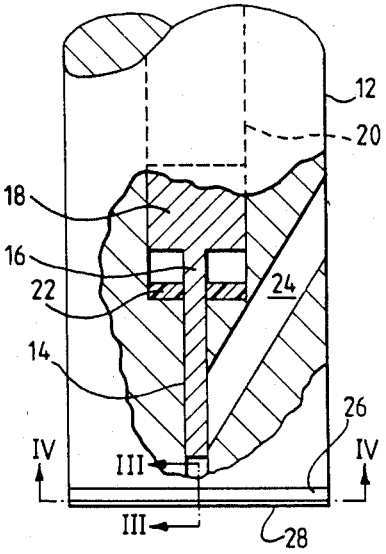
FIG. 2 is a side view, partly broken away, of a first embodiment of the system.
Figure 3:
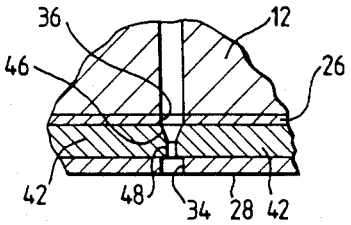
FIG. 3 is a partial sectional view along line III—III of FIG. 2.
Figure 4:
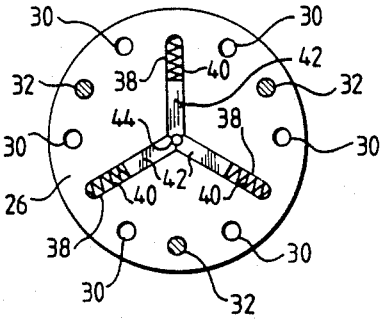
FIG. 4 is a view along line IV-IV of FIG. 2.

Referring now to FIGS. 2 to 4, there is shown part of a system for securing ferrules of the type shown in FIG. 1 to a substrate. The system comprises a body 12 which defines a cylindrical channel 14. The diameter of the channel 14 is marginally larger than that of the outer diameter of the step 7 in the ferrule.

A hammer rod 16, which is connected to a piston 18, is reciprocable in the channel 14. The body 12 also defines a cylinder 20 in which the piston 18 is reciprocable. A shock absorbing rubber washer 22 is located at the bottom end of the cylinder 20.

The hammer rod 16 is reciprocated by a double acting pneumatic ram which includes the piston 18 and cylinder 20. The arrangement of this ram needs no further description as suitable constructions and operations are well known to those skilled in the art.

The body 12 also defines a passageway 24 for feeding a nailed ferrule into the channel 14. The passageway 24 may be stepped along its length to provide further guidance for the nailed ferrule The end of the passageway 24 remote from the channel 14 is connected via an air blow system to a vibratory bowl hopper (not shown). The hopper and air blow system can be used to supply nailed ferrules to a number of bodies 12. Such systems are well known in the art and need no further description. One such conventional vibrating hopper and pneumatic feeder is illustrated in FIG. 7.

A collet body 26 and a collet plate 28 are located on the bottom (as viewed in FIG. 2) of the body 12. The collet body 26, which is shown in FIG. 4, has in it a plurality of holes 30 and studs 32 arranged symmetrically around its periphery. The collet plate 28 has in it a plurality of holes (not shown) complementary to the holes 30 and studs 32 in the collet body 26. The body 12 has a plurality of tapped holes (not shown) complementary to the holes 30 in the collet body 26.

Thus, the collet body 26 and collet plate 28 can be removably secured to the body 12 by bolts (not shown) passing through the holes in the plate 26 and the holes 30 in the collet body 26 and screwed into the holes in the body 12. The collet body 26 and plate 28 are also held in the correct orientation by fitting the studs 32 into the holes in the plate 28.

The collet plate 28 also has in it a central hole 34 which is marginally larger in diameter than the ferrule. The collet body 26 also has in it a central hole 36 of the same size.

Three symmetrically arranged radial grooves 38 are formed in the bottom surface (as viewed in FIG. 2) of the collet body 26 around the central hole 36. A coil spring 40 is located in the radially outward end of each groove 38. A collet piece 42 is located in each groove 38 in abutment with its respective spring 40.

The springs 40 are compressed so that the collet pieces 42 are biased towards each other, as shown in FIG. 4. The radially inward ends of the collet pieces are shaped so that they form a passage 44 having a tapered section 46 and a cylindrical section 48.

The open end of the tapered section 46 is of the same diameter as the central hole 36 in the collet body 26. The cylindrical section 48 has a diameter such that the shaft of a nail in a nailed ferrule will only just pass therethrough.

In use, the hammer rod 16 will be retracted from the position shown in FIG. 2 until it is clear of the passageway 24. The feed means is then actuated electronically or pneumatically in a manner known in the art to feed a nailed ferrule through the passageway 24 into the channel 14 with the nail depending from the ferrule.

The nailed ferrule then moves down in the channel 14 until the point of the nail abuts the tapered section 46 of the passage 44. The tapered section 46 guides the nail into and through the cylindrical section 48 until the bottom of the ferrule abuts the tapered section 46. Thus the nailed ferrule moves to a position in which the nail is substantially coaxial with the channel 14.

The system is then activated to drive the hammer rod 16 along the channel 14 and strike the head of the nail. As the nail is struck, the ferrule is caused to bear on the collet pieces 42 and force them radially outward against the bias of the springs 40. Thus, the nailed ferrule can be secured to the substrate and can be released from the system in one operation. Once the nailed ferrule has been removed, the collet pieces 42 are forced back towards each other by the springs 40 to reform the passage 44, ready to receive another nailed ferrule.

It can thus be seen that the system described above can be used to secure accurately and reproducibly nailed ferrules to substrates.

Figure 6:
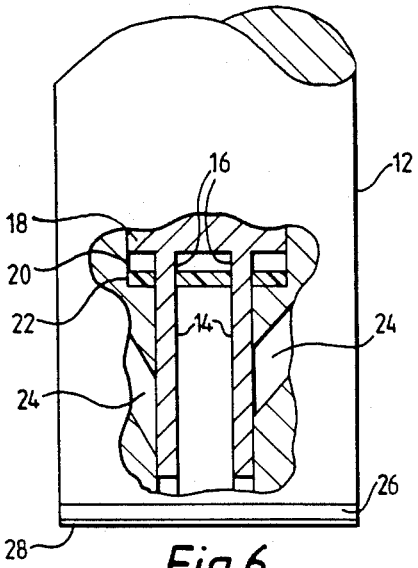
FIG. 6 is a view similar to that of FIG. 2 of the second embodiment.
Figure 5:
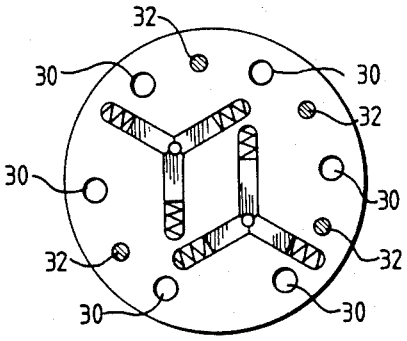
FIG. 5 is a view similar to that of FIG. 4 of a second embodiment of the system.

A second embodiment of a system of the invention is shown in FIGS. 5 and 6 to which reference is now made. This is essentially similar to that shown in FIGS. 2 to 4, in that it comprises a body 12, piston 18, cylinder 20, rubber washer 22, collet body 26 and collet plate 28. The body 12, collet body 26 and collet plate 28 are provided with the appropriate holes 30 and studs 32 for securement and alignment of the collet mechanism on the body 12.

The second embodiment differs from the first in that it has two each of channels 14, hammer rods 16, passageways 24 and collet piece arrangements. Each collet piece arrangement is identical to the arrangement shown in particular in FIG. 4.

It is believed that the operation of the second embodiment is evident from the above description referring to the first embodiment. The second embodiment has all the advantages of the first embodiment but is addition has the advantage that it allows two nailed ferrules to be secured to a substrate in a corner where there is a shortage of space.

It will be appreciated that the automatic nailer system of the present invention has been described above purely by way of illustration. It will be apparent to those skilled in the art that variations and modifications can be made without departing from the true scope of the invention.

I claim:

1. An automatic nailer system, for securing nailed ferrules to a substrate, comprising:

a body defining a generally cylindrical channel for receiving a nailed ferrule with the nail and the channel being approximately coaxial;

a hammer rod having a free end reciprocable within the channel between a retracted position and an extended position;

means for feeding a nailed ferrule into the channel when the hammer rod is in its retracted position; and a collet mechanism comprising a plurality of collet pieces which are biased to move radially to abut one another and define a passage;

the passage having a tapered section which at its opening and wider end has a cross-sectional size and shape generally the same as those of the channel and leading at its other end into a generally cylindrical section for receiving coaxially and snugly the nail of a nailed ferrule, the collet mechanism being located on the end of the body remote from the hammer rod such that the channel and the passage are coaxial and the wider end of the tapered section is adjacent the channel, and the free end of the hammer rod in its extended position extending at least as far as the wider end of the tapered section of the passage.

2. The system of claim 1, wherein the ferrule, the channel and the passage are each circular in cross-section.

3. The system of claim 1, wherein the hammer rod is connected to a piston which comprises part of a pneumatic ram.

4. The system claim 3, wherein the ram is double acting, whereby it moves the hammer rod both into and out of its extended position.

5. The system of claim 1, wherein the means for feeding nailed ferrules into the channel comprises an appropriately shaped passageway connecting the channel to the outside of the body.

6. The system of claim 5, wherein the axis of the passageway is at an acute angle to the axis of the channel.

7. The system of claim 5, wherein the nailed ferrules are fed to the passageway by means of a vibratory bowl hopper, for receiving a substantial number of nailed ferrules, and a pneumatic feed system, for feeding such nailed ferrules one at a time to the passageway.

8. The system of claim 1, wherein the collet mechanism comprises three collet pieces arranged symmetrically around a common axis.

9. The system of claim 1, wherein the collet pieces are arranged in grooves in a collet body and held in place by a collet plate secured to the collet body.

10. The system of claim 1, wherein the collet pieces are biased by spring means.

11. The system of claim 1, wherein the angle of the tapered section with respect to the axis of the passage is less than 45° so as to ensure that the collet pieces are easily moved against the bias by the action thereon of the ferrule.

12. The system of claim 1, wherein the body contains a plurality of sets of components so that a plurality of nailed ferrules can be secured to a substrate.

13. A collet mechanism, for use in an automatic nailer system of claim 1, comprising a plurality of collet pieces which are biased to move radially to abut one another and define a passage having a tapered section which at its opening has a cross-sectional size and shape generally the same as those of a ferrule to be located therein and leading at its other end into a generally cylindrical section for receiving coaxially and snugly the nail of a nailed ferrule.

14. The mechanism of claim 13, which comprises three collet pieces arranged symmetrically around a common axis.

15. The mechanism of claim 13, wherein the collet pieces are arranged in grooves in a collet body and held in place by a collet plate secured to the collet body.

16. The mechanism of claim 13, wherein the collet pieces are biased by spring means.

17. The mechanism of claim 13, wherein the angle of the tapered section with respect to the axis of the passage is less than 45° so as to ensure that the collet pieces are easily moved against the bias by the action thereon of the ferrule.

18. The mechanism of claim 13, which includes a plurality of components whereby a plurality of passages are defined.

* * * * *

UNITED STATES PATENT AND TRADEMARK OFFICE

CERTIFICATE OF CORRECTION

PATENT NO. : 4,858,814

DATED : August 22, 1989

INVENTOR(S) : Terry Ernest Francis

It is certified that error appears in the above-identified patent and that said Letters Patent is hereby corrected as shown below:

In the drawings, Sheet 2, Fig. 7, should be added as per attached sheet.

Signed and Sealed this

Twelfth Day of June, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,858,814

DATED : August 22, 1989

INVENTOR(S) : Terry Ernest Francis

It is certified that error appears in the above-identified patent and that said Letters Patent is hereby corrected as shown below:

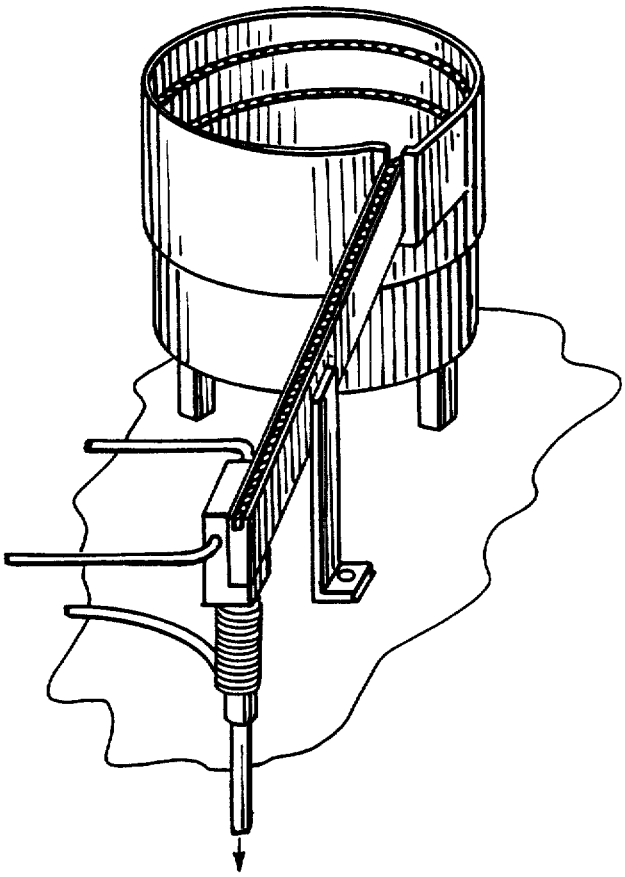

FIG. 7